United States Patent [19]

Karol et al.

[11] Patent Number: 4,460,381

[45] Date of Patent: Jul. 17, 1984

[54] PROCESS FOR STABILIZING FUELS AND STABILIZED FUEL PRODUCED THEREBY

[75] Inventors: Thomas J. Karol, Wappingers Falls; Rodney L. Sung, Fishkill, both of N.Y.

[73] Assignee: Texaco Inc., White Plains, N.Y.

[21] Appl. No.: 493,557

[22] Filed: May 11, 1983

[51] Int. Cl.[3] ..... C10L 1/22

[52] U.S. Cl. ..... 44/63; 252/403; 544/379

[58] Field of Search ..... 44/63; 544/379; 252/403

[56] References Cited

U.S. PATENT DOCUMENTS

| | | | |
|---|---|---|---|
| 3,185,704 | 5/1965 | Kahn et al. | 44/63 |
| 3,401,118 | 9/1968 | Benoit, Jr. | 44/63 |
| 3,443,918 | 5/1969 | Kautsky et al. | 44/63 |
| 3,452,002 | 6/1969 | Brasch | 44/63 |
| 3,455,832 | 7/1969 | Davis | 44/63 |
| 3,458,530 | 7/1969 | Siegel et al. | 44/63 |
| 4,257,780 | 3/1981 | Sung et al. | 44/63 |
| 4,313,738 | 2/1982 | Parlman et al. | 44/63 |

*Primary Examiner*—Thomas A. Waltz
*Assistant Examiner*—Y. Harris-Smith
*Attorney, Agent, or Firm*—Robert A. Kulason; Henry W. Archer; James J. O'Loughlin

[57] ABSTRACT

A process for stabilizing fuels during storage by blending therewith oxalic acid derivatives of mono- or bis-succinimides of polyalkylpolyamines. The fuels are stabilized by the presence of 10 to 100 parts per thousand barrels of these oxamides. For particular applications mixtures of mono- and bis-succinimides in varying proportions can be used.

7 Claims, No Drawings

PROCESS FOR STABILIZING FUELS AND STABILIZED FUEL PRODUCED THEREBY

FIELD OF THE INVENTION

This invention relates generally to fuels for internal combustion and diesel engines. More particularly the invention concerns a process for stabilizing middle distillates and oil-derived diesel fuels against the formation and precipitation of sediments during storage and use.

Middle distillate fuels and diesel fuel fractions from the hydrogenation of residues tend to deteriorate on exposure to air on standing at room temperature for extended lengths of time. This depends in part on the composition of the blending stocks which make up the fuel; for example, in many cases, the greater amount of cracked stock in the blend the greater the instability of the fuel. Other factors include cleanliness of the fuel, exposure to light and conditions of storage. Sediment formation takes place in an uninhibited fuel which tends to plug strainers, burner tips, and injectors. In diesel fuel, such sediment tends to form sludge and varnish in the engine. If the oil is used as a heat exchange medium, as for example, with jet fuel, the sediment tends to plug exchange coils. It is apparent, therefore, that reduced sediment formation in hydrocarbon oils is very important. The invention prevents agglomeration and/or settling of the formed particulate matter by effectively maintaining the fine particles in a well dispersed state, so that the difficulties associated with the sediment formation either do not occur or are of substantially lessened severity.

SUMMARY OF THE INVENTION

In accordance with this invention, there is provided a process for stabilizing fuels during storage by blending therewith from 10 to 100 parts per thousand barrels of at least one succinimide-oxamide of the formulas

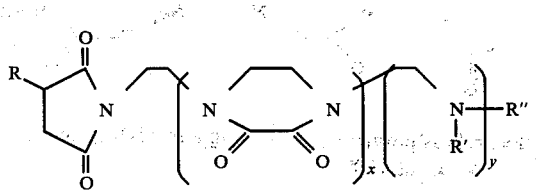

(I)

and

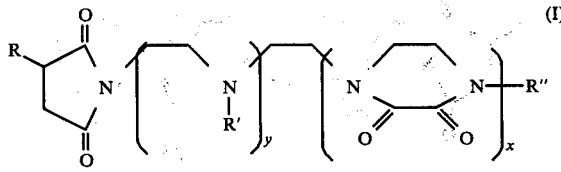

(I)

in which R is a hydrocarbyl radical having from 8 to 400 carbon atoms, x and y are numbers ranging from 0 to 6 whose additive total is from 1 to 6, R' is a hydrogen radical or a mono-, or a bi-acyl radical of oxalic acid, and R'' is a hydrogen or hydrocarbyl substituted succinic-N-ethylene radical having the formula:

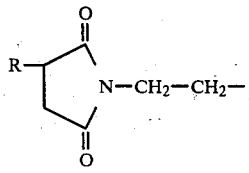

The invention also provides diesel and middle distillate fuels stabilized by the presence therein of about 10 to about 100 parts per thousand barrels of one or more succinimide-oxamide as above defined.

DISCLOSURE OF BEST MODES

For the purposes of this invention, "Middle Distillates" can be defined as having a boiling point range of about 150° to 350° C., a pour point of between about −20° and +30° F., and a specific gravity at 50° F. of 0.770 to 0.901.

One example of such fuel has the following specifications:

| | |
|---|---|
| API Gravity ° | 35.2 |
| Kin. Vis., 1.-° F. cs | 2.86 |
| Flash Point, °F. | 162 |
| Pour Point, °F. | +5 |
| Cloud Point, °F. | +4 |
| ASTM Distillation, °F. | |
| 10% | 426 |
| 30% | 479 |
| 50% | 517 |
| 70% | 554 |
| 90% | 597 |
| 95% | 615 |
| EP | 628 |

The standard specifications for diesel fuel oils are determined as indicated by ASTM D975-81 in the 1982 Annual Book of ASTM Standards. The diesel fuels with which this invention particularly is concerned have an API Gravity of about 34–35, a sulfur content of about 0.16 to 0.45, a cetane number of 40–55, a pour point of −5° to +10° F. and an aromatics volume percent of about 40 to 50.

Diesel fuel from synthetic origin typically has the following specifications:

| | |
|---|---|
| Flash Point, FCM | 280 |
| Cloud Point, °F. | +5 |
| Pour Point, °F. | 0 |
| Kin Vis cs @ 40° F. | 4.3 |
| Cetane | 50.6 |
| FIA Analysis | |
| A % | 35.5 |
| O % | 12.5 |
| S % | 52.0 |
| S % | 0.41 |
| Corr. Cu Strip 3 Hr. 122° F. | 1A |
| API Gravity | 31.4 |
| ASTM Distillation, °F. | |
| IBP | 540 |
| 10% | 556 |
| 30% | 561 |
| 50% | 566 |
| 70% | 572 |
| 90% | 582 |
| EP | 593 |

The succinimide-oxamides used as stabilizing additives for the above fuels are disclosed and claimed in coassigned copending U.S. patent application Ser. No. 495,295 filed May 16, 1983. As set forth therein, these oxamides are prepared by reacting a polyalkyleneamine succinimide with an amount of oxalic acid sufficient to react with at least 30 percent of the reactive nitrogen moieties on the succinimide chain and have the formulas:

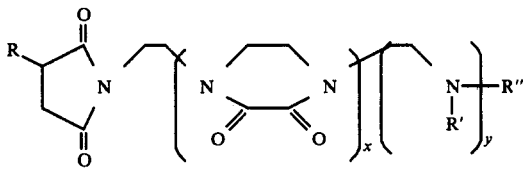

(I)

and

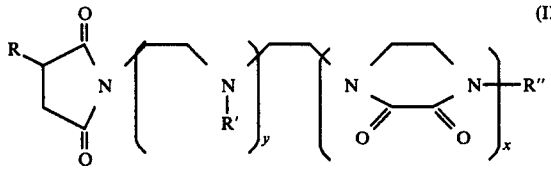

(II)

in which R is a hydrocarbyl radical having from 8 to 400 carbon atoms, x and y are numbers range from 0 to 6 whose additive total is from 1 to 6, R′ is a hydrogen radical or a mono-, or a bi-acyl radical of oxalic acid, and R″ is a hydrogen or hydrocarbyl substituted succinic-N-ethylene radical having the formula:

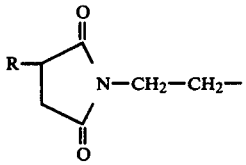

Exemplary useful compounds of the above formulas are presented in tabular form below:

| Example | R | X | Y | R′ | R″ |
|---|---|---|---|---|---|
| | | FORMULA I | | | |
| 1 | 8 carbon atoms | 0 | 6 | H | H |
| 2 | 40 carbon atoms | 6 | 0 | H | H |
| 3 | 200 carbon atoms | 3 | 3 | mono-xayl | alkenyl succinyl-N—ethylenyl |
| 4 | 400 carbon atoms | 2 | 4 | bio-xayl | alkenyl succinyl-N—ethylenyl |
| | | FORMULA II | | | |
| 5 | 16 carbon atoms | 0 | 6 | H | H |
| 6 | 32 carbon atoms | 6 | 0 | H | H |
| 7 | 200 carbon atoms | 3 | 3 | mono-xayl | alkenyl succinyl-N—ethylenyl |
| 8 | 400 carbon atoms | 2 | 4 | bio-xayl | alkenyl succinyl-N—ethylenyl |

The efficacy of the additives of the invention was determined by means of the Potential Deposit Test which is used in the trade to predict the long term stability of fuels at room temperature in the presence of air.

In carrying out this test, the fuel sample is heated for two hours at 275° F. while air is being bubbled through the fuel at a rate of 3 liters per hour. At the end of the heating period the fuel is cooled at 77° F. for one hour and filtered through a 0.6 sq. cm. area of a No. 1 Whatman filter paper. The density of the insoluble material deposited on the filter paper is visually compared to the Deposit Code which has been correlated with actual field test results, on the basis of the numbers of the code ranges from 0 (good) to +4 (bad).

Alternately, a Reflection Meter, Model 610 Photovolt Reflection Meter, or equivalent type, may be used in the procedure, with the results expressed simply in terms of Meter readings. If this procedure is employed, the meter is "zeroed" on 100, using a clean, unused PDT filter disc. The results should state whether a white backup was employed.

In examples of the successful practice of the invention 25 PTB of mono- and bis-imide oxamides of the formula were blended at room temperature using suitable blending means in the diesel fuel and the middle distillate having the above-given specifications. The resulting blends and the base fuels were evaluated by the Potential Deposit Test with the following results:

TABLE I

| | 25 PTB Add. | None |
|---|---|---|
| Potential Deposit Test Ratings | | |
| Base Fuel (Diesel Fuel Cut) | — | 3 |
| Base Fuel + mono-imide oxamide | 1 | — |
| Base Fuel + bis-imide oxamide | 1 | — |
| Potential Deposit Test Ratings* | | |
| Base Fuel (Middle Distillate) | 4+ | |
| Base Fuel + 25 PTB of bis-imide oxide | 2 | |
| Base Fuel + 25 PTB of mono-imide oxamide | 1 | |

*0 Good 4+ bad

The above data show both the mono- and bis-imide oxamides to improve the stability of both classes of fuel. The particular bis-imide oxamide and the mono-imide oxamide have the formulas given below:

Mono-imide Oxamide

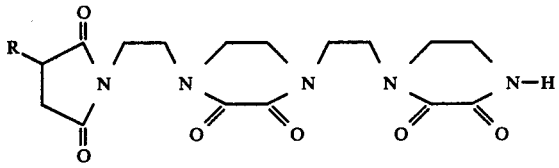

wherein R is polyisobutenyl having a molecular weight (MW) of about 1300

Bis imide Oxamide

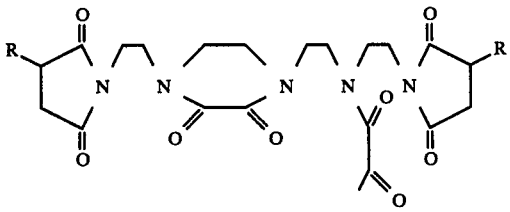

wherein R is as above.

What is claimed is:

1. A process for stabilizing middle distillate and diesel fuels which comprises blending with said fuels from 10 to 100 parts per thousand barrels of at least one mono- or bis-imide oxamide of the formulas

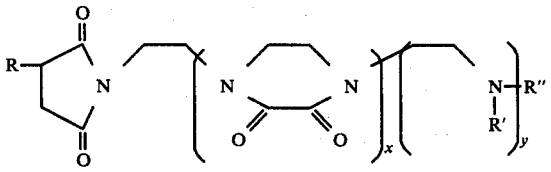

and

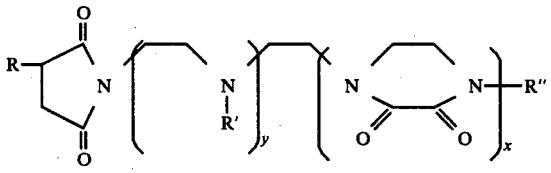

in which R is a hydrocarbyl radical having from 8 to 400 carbon atoms, x and y are numbers range from 0 to 6 whose additive total is from 1 to 6, R′ is a hydrogen radical or a mono-, or bi-acyl radical of oxalic acid, and R″ is a hydrogen or hydrocarbyl substituted succinic-N-ethylene radical having the formula:

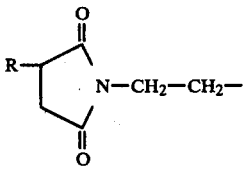

2. A stabilized middle distillate or diesel fuel containing from about 10 to about 100 parts per thousand barrels of at least one mono- or bis-imide oxamide of the formulas

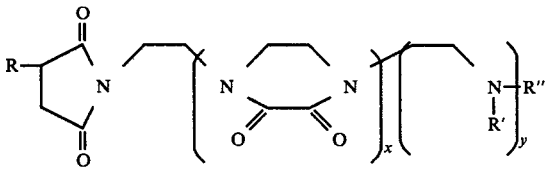

and

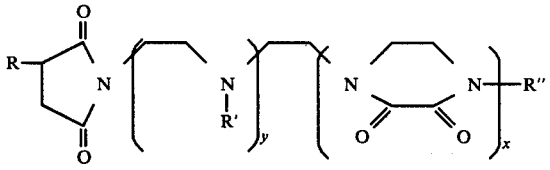

in which R is a hydrocarbyl radical having from 8 to 400 carbon atoms, x and y are numbers range from 0 to 6 whose additive total is from 1 to 6, R′ is a hydrogen radical or a mono-, or bi-acyl radical of oxalic acid, and R″ is a hydrogen or hydrocarbyl substituted succinic-N-ethylene radical having the formula:

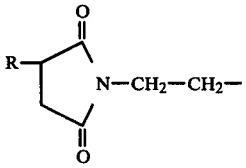

3. The fuel of claim 2, wherein R and R‴ are hexadecenyl; X is 0; y is 6; and R′ is hydrogen.

4. The fuel of claim 2 wherein R is polyisopropenyl; x is 6; y is 0; and R′ and R″ are hydrogen.

5. The fuel of claim 2, wherein R is polyisopropenyl; x and y are 3; R′ is bioxalyl; and R″ is alkenyl succinyl-N-ethylenyl.

6. The fuel of claim 2 wherein R is polyisopropenyl; x is 0; y is 4; R′ is bioxalyl; and R″ is alkenyl succinyl-N-ethylenyl.

7. The fuel of claim 2 containing a mixture of said mono- and bis-imide oxamides.

* * * * *